United States Patent [19]

von Kaler et al.

[11] Patent Number: 4,982,566

[45] Date of Patent: Jan. 8, 1991

[54] EXPANDER BAND FOR HYDROSTATIC TRANSMISSION

[76] Inventors: Roland von Kaler, 9402 Pleasant Dr., Tecumseh, Mich. 49286; Christian H. Thoma, Chalet Abaco, Green Road, St. Clement, Jersey, Great Britain

[21] Appl. No.: 482,974

[22] Filed: Feb. 22, 1990

[51] Int. Cl.[5] ..... F01B 13/06; F04B 19/02

[52] U.S. Cl. ..... 60/487; 417/462; 92/58; 91/491; 91/497; 60/464

[58] Field of Search ..... 417/462, 273; 92/58, 92/66, 72; 91/491, 497, 498, 492; 60/464, 487, 490

[56] References Cited

U.S. PATENT DOCUMENTS 3,751,924 8/1973 Brown et al. ..... 60/487
4,030,405 6/1977 Aldinger et al. ..... 92/58
4,635,535 1/1987 Thoma et al. ..... 91/491
4,691,512 9/1987 Thoma et al. ..... 60/487
4,914,914 4/1990 Inoue ..... 60/487

*Primary Examiner*—Leonard E. Smith
*Assistant Examiner*—M. Kocharov
*Attorney, Agent, or Firm*—Young & Thompson

[57] ABSTRACT

The present invention is an expander band for use in hydraulic pumps, motors, and hydrostatic transmissions. The band has a plurality of elongated slots located circumferentially which receive slippers attached to pistons. One reduced dimension slot fixes the position of a slipper relative to the expander band while the other slippers move within the elongated slots. The fixed slipper limits the range of movement of the other slippers relative to the band, and thus the slippers avoid abutting the side ends of the elongated slots.

12 Claims, 3 Drawing Sheets

EXPANDER BAND FOR HYDROSTATIC TRANSMISSION

BACKGROUND OF THE INVENTION

The invention relates to hydrostatic transmissions. More specifically, the field of the invention is that of expander bands used in radial piston hydraulic pumps and motors. Where a radial piston hydraulic pump is fluidly coupled to a radial hydraulic motor, it is known by the name hydrostatic transmission.

A hydrostatic transmission transmits energy from mechanical rotary motion to fluid (typically oil) movement, then back to mechanical rotary motion. Within a transmission, a cylinder unit is eccentric to and rotates on a pintle, with pistons positioned within the cylinders and attached to slippers mounted in an expander band, so that as the cylinder unit rotates the pistons are driven by the slippers which engage the surrounding eccentric annular track ring. The pistons of the driving cylinder unit create a pressurized fluid flow that drives a receiving set of pistons which drive an output shaft. The transmission ratio is directly proportional to the eccentricity of the track ring relative to the pintle. U.S. Pat. Nos. 4,635,535 and 4,691,512, which are incorporated by reference herein, describe hydraulic units which may be used within a hydrostatic transmission.

One conventional design of an expander band includes a plurality of slots circumferentially disposed at approximately equal distances. The expander band slots allow the slippers to migrate from one end of the slot to the other as the cylinder unit rotates, preventing the hydraulic pump or motor from binding up. Unfortunately, the slippers tend to impact against and abrade the ends of the slots, which causes wear on the ends of the slots and slippers. This wear can affect pump performance and require repair or replacement. In addition, the ends can chip away, causing metal particles to be introduced in the oil. Debris in the circulating oil can limit the efficiency and life of the pump, and in the worst case cause it to fail.

What is needed in the art is an expander band assembly for a hydrostatic transmission which minimizes wear and chipping. Also needed is an expander band assembly which is simple and economical for use within a hydrostatic transmission. A further need exists for an expander band assembly which positions the slippers without binding.

SUMMARY OF THE INVENTION

In the present invention the expander band is located in a fixed position relative to one slipper to define the position of the expander band relative to the other slidable slippers. The expander band is thus positioned to rotate in unison with the cylinder unit, while allowing all the slippers except one a limited range of circumferential movement to accommodate the rotation of the cylinder unit. By having the band and one slipper fixed in position, the overall wear on the other slippers and the expander band is minimized, prolonging the life of the hydrostatic transmission.

The expander band is economically made by forming slots in the band to receive the slippers of the hydraulic pump and motor, then bending the band to form an annular shape. Preferably, the fixed slot is the middle slot on the band having edge flanges contoured to the shape of the slipper to restrict its movement. The other elongated slots are rectangularly shaped to receive the remaining slippers, allowing the slippers to move within the elongated slots.

The present invention, in one form, is a hydrostatic transmission comprising a hydraulic pump and a hydraulic motor, wherein the hydraulic pump is in fluid communication with the pintle and is coupled to an input shaft. The hydraulic motor is in fluid communication with the pintle and is coupled to an output shaft. Both the pump and the motor are radial piston hydraulic units having a cylinder unit, and each has a track ring positioned eccentrically around the pintle. The expander band assembly is disposed around each cylinder unit within its corresponding track ring, and the band receives a plurality of slippers which are attached to the pistons. The expander band has a plurality of variable holding means comprising elongated slots disposed circumferentially for holding and allowing limited circumferential movement of the slippers, and a fixed holding means comprising one reduced dimension slot for holding one slipper in a fixed position relative to the expander band. As the cylinder unit rotates, the other slippers and band move relative to each other within a predefined range.

One object of the present invention is to provide an expander band assembly which prevents the slippers from abrading the sides of the slots in the band.

Another object of the present invention is to provide an expander band assembly which improves the efficiency of a hydrostatic transmission without significant design changes to the transmission assembly.

A further object of the present invention is to provide an expander band assembly which fixes the position of one slipper relative to the expander band, thus limiting the relative circumferential movement of the other slippers and band without causing binding.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
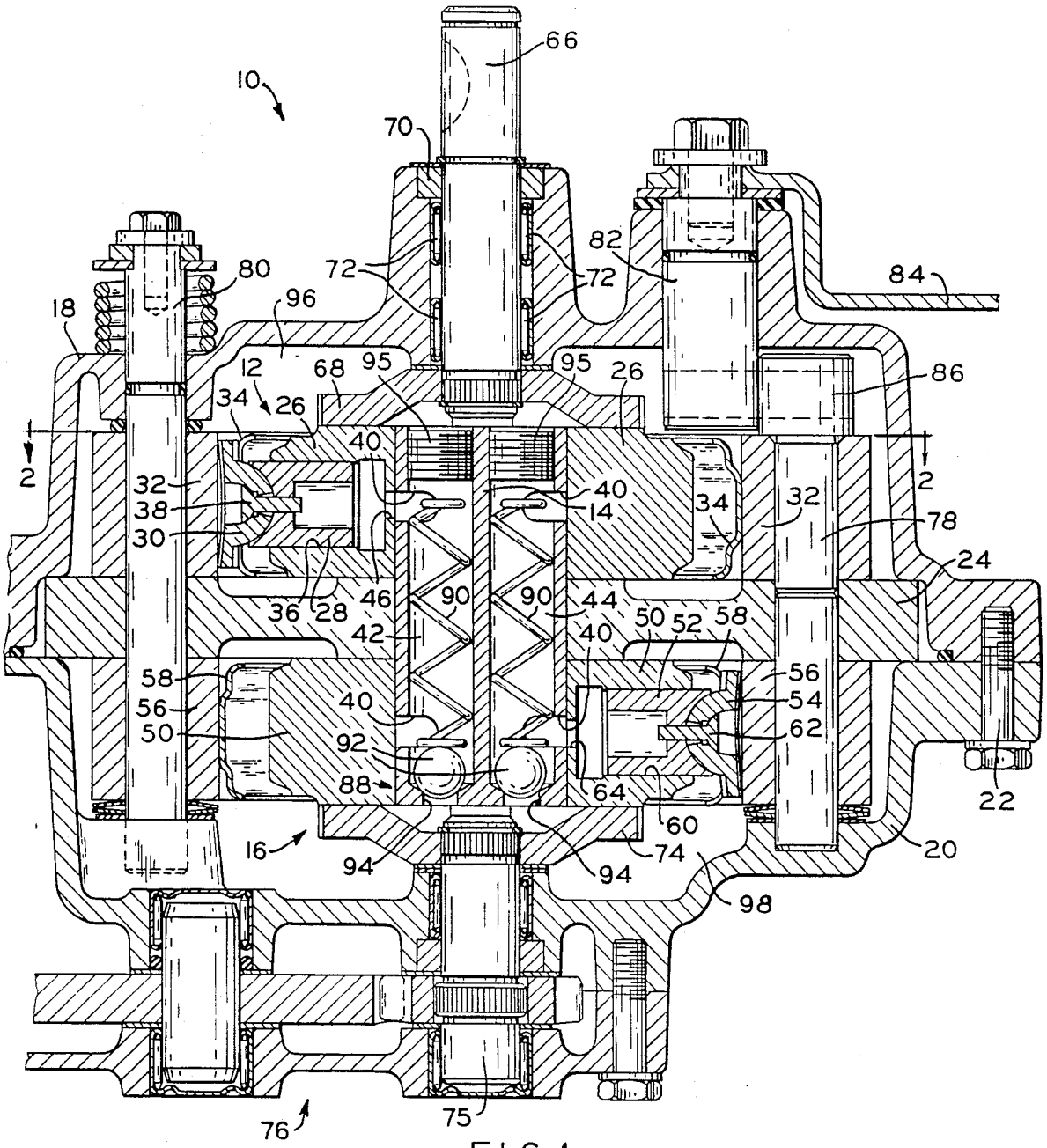
FIG. 1 is a sectional view of the hydrostatic transmission including the improved expander band of the present invention.
Figure 2:
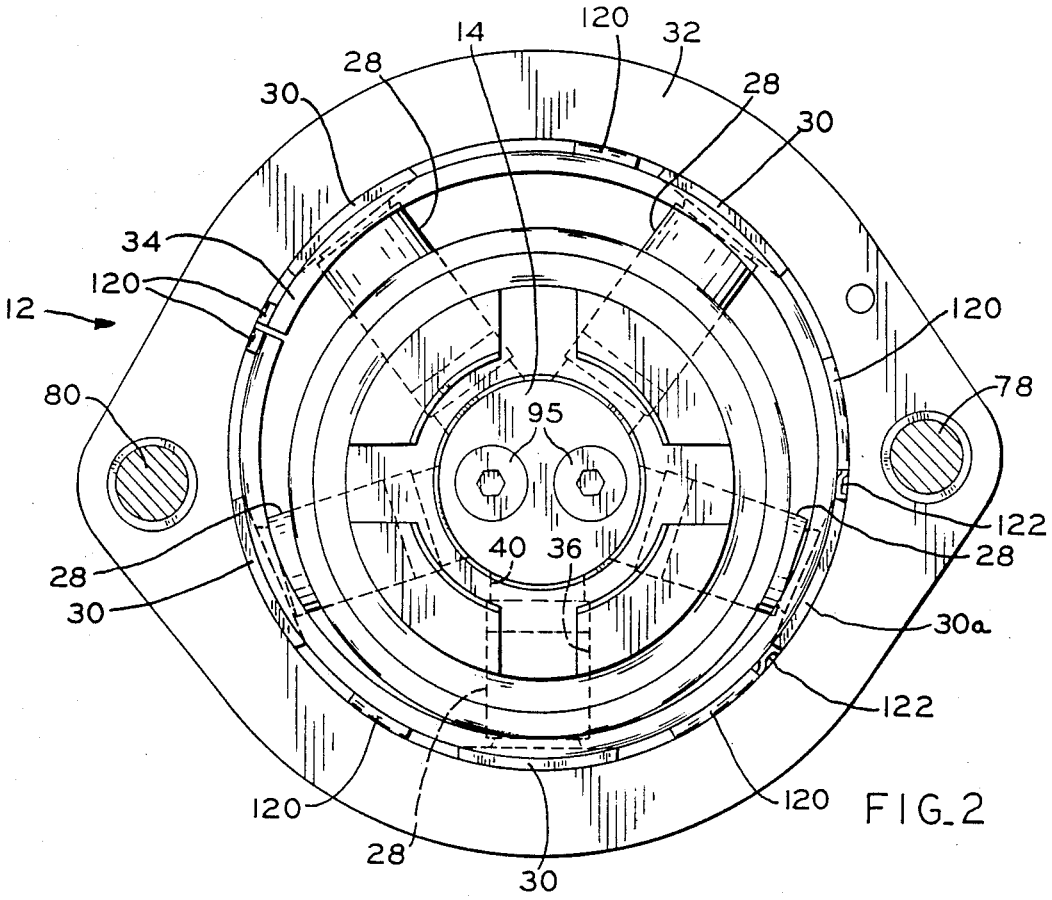
FIG. 2 is a view taken along view line 2—2 of FIG. 1 in the direction of the arrows.

Corresponding reference characters indicate corresponding parts throughout the several views. The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

The drawings show a portion of a hydrostatic transaxle, which has a hydrostatic unit 10 as shown in FIG. 1 constructed in accordance with an embodiment of the present invention. Hydrostatic unit 10 comprises pump 12, pintle 14, and motor 16. Upper and lower housings 18 and 20 enclose hydrostatic unit 10 and contain hydraulic fluid; the housings 18 and 20 are attached together by a plurality of bolts 22. A pintle support member 24 separates pump 12 from motor 16, while allowing pintle 14 to extend therethrough.

Pump 12 comprises a cylinder unit 26, pistons 28, slippers 30, track ring 32, and expander band 34. Cylinder unit 26 is rotatably disposed about pintle 14 which provides an axis for rotation. Cylinder unit 26 comprises a plurality of cylinders 36 which are in a fixed axial position relative to pintle 14 and receive the pistons 28. Pistons 28 are positioned within cylinders 36 of cylinder unit 26, and have connecting rivets 38 which attach to corresponding slippers 30. Positioned eccentrically around pintle 14, track ring 32 activates pistons 28. Slippers 30 are urged radially outwardly by expander band 34 so that as cylinder unit 26 rotates, slippers 30 cause pistons 28 to reciprocate radially within cylinders 36. Expander band 34 is preferably a rolled metallic strip of 17 gauge type 1008–1020 spring steel which resiliently holds slippers 30 against track ring 32.

Pintle 14 provides an axis for the rotation of cylinder unit 26, and has pintle ports 40 and passages 42 and 44 for fluid communication between pump 12 and motor 16. Cylinder ports 46 are formed in the axially interior region of cylinder unit 26 and become aligned with pintle ports 40 during the rotation of cylinder unit 26.

Motor 16 comprises a cylinder unit 50, pistons 52, slippers 54, track ring 56, and expander band 58. Cylinder unit 50 is rotatably disposed about pintle 14 which provides an axis for rotation. Cylinder unit 50 comprises a plurality of cylinders 60 which are in a fixed axial position relative to pintle 14 and receive the pistons 52. Pistons 52 are positioned within cylinders 60 of cylinder unit 50, and have connecting rivets 62 which attach to corresponding slippers 54. Cylinder ports 64 are formed in the axially interior region of cylinder unit 50 so they can be matched with pintle ports 40 during the rotation of cylinder unit 50. Positioned eccentrically around pintle 14, track ring 56 activates pistons 52. Slippers 54 are urged radially outwardly by expander band 58 so that as cylinder unit 50 rotates, slippers 54 cause pistons 52 to reciprocate within cylinders 60. Expander band 58 is preferably a rolled metallic strip which resiliently holds slippers 54 against track ring 56.

Rotational movement is imparted to pump 12 by input shaft 66 which extends through upper housing 18 to provide the driving force for pump 12 via member 68. Oil seal 70 on upper housing 18 seals input shaft 66; to rotationally support shaft 66, needle bearings 72 are located within upper housing 18 By this structure rotation is imparted to pump 12, which pumps hydraulic fluid through pintle 14 to drive motor 16 and member 74 to drive output shaft 75 and its associated gear train 76. Hydraulic fluid (e.g., oil) is circulated within hydraulic unit 10 to transmit motion from input shaft 66 by converting the motion to fluid pressure by pump 12, and then by converting the fluid pressure to motion by motor 16 for driving output shaft 74.

In order to pump pressurized fluid to translate the rotation of shaft 66 to output shaft 74, the circles defined by pintle 14 and track ring 32 must be eccentric. Control shaft 78 determines the transmission ratio by pivoting track ring 32 about control rod 80, thus varying the eccentricity of track ring 32 relative to pintle 14. Control rod 80 extends through track ring 32 and is fixed in position relative to pintle 14, while track ring 32 has a limited ability to pivot about rod 80. To move control shaft 78, shaft 82 is mounted in upper housing 18 and is rotated by adjusting lever 84. Coupling arm 86 translates the rotary movement of lever 84 and shaft 82 to lateral swinging movement of control shaft 78.

As configured in the preferred embodiment, control shaft 78 moves within a range bounded by two positions. The first position defines a minimum angle between the line defined by the center of pintle 14 and control rod 80 and the line defined by control rod 80 and control shaft 78. The angle increases as control shaft 78 moves to its second position which defines a maximum angle between the line defined by the center of pintle 14 and control rod 80 and the line defined by control rod 80 and control shaft 78. The angle, and hence the degree of eccentricity, increases as control shaft 78 travels from its first to its second position.

As cylinder unit 26 is rotated, pistons 28 within cylinders 36 are rotated causing their corresponding slippers 30 to orbit pintle 14 elliptically. As slippers 30 move, they cause expander band 34 to rotate within track ring 32. Slippers 30 are resiliently held against track ring 32 by expander band 34 so their radial positions are generally defined by cylinders 36 of cylinder unit 26. As a practical matter, slippers 30 tend to reposition themselves slightly within expander band 32 during each rotation. However, pistons 28 move from the closest relative position to the farthest relative position during every rotation of cylinder unit 26. By so moving, pistons 28 create a pressurized fluid flow within passages 42 and 44.

To provide fluid access to passages 42 and 44, check valves 88 are located near the bottom of passages 42 and 44 of pintle 14. Check valves 88 comprise a pintle spring 90 which holds a steel ball 92 over pintle discharge openings 94. Normally, pintle springs 90 hold balls 92 in place within openings 94. Plugs 95 are screwed into threads of pintle 14 to close the tops of passages 42 and 44, thus hermetically sealing the tops.

Hydrostatic unit 10 includes an oil reservoir (not shown) to provide fluid for circulation within hydrostatic unit 10. Housings 18 and 20 define oil cavities 96 and 98, respectively, which are normally maintained full of oil. Also, pintle support member 24 allows oil to flow between oil cavities 96 and 98 so oil can circulate within hydrostatic unit 10.

Figure 3:
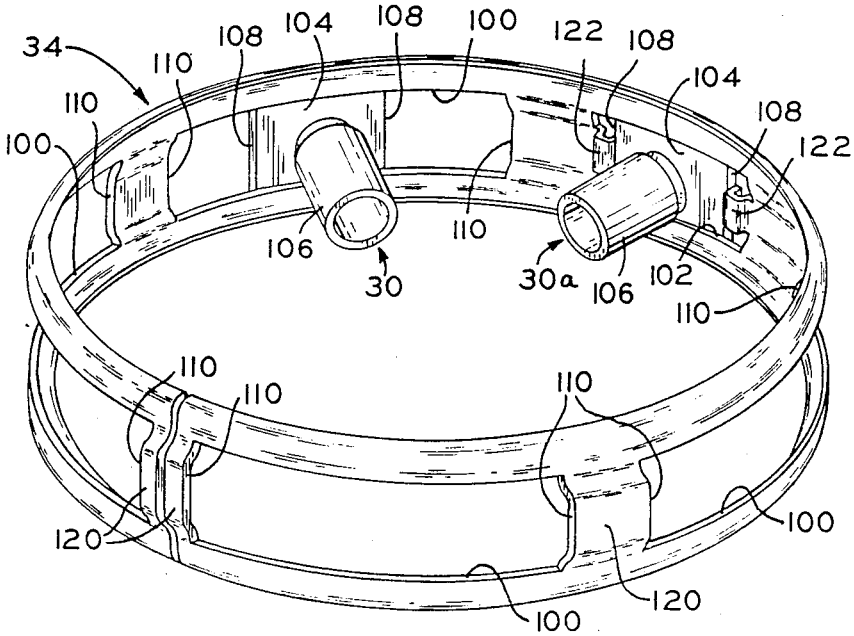
FIG. 3 is a perspective view of the expander band of the present invention.

According to a preferred form of the present invention, a perspective view of expander band 34 (which is similar to expander band 58 with respect to the following description) is shown in FIG. 3. Being of generally annular shape, expander band 34 has a plurality of elongated rectangular slots 100 which are large enough in height to receive a slipper 30, and preferably elongated slots 100 have a width from two to three times the width of slippers 30. The height of elongated slots 100 is designed to hold slippers 30 in a fixed axial position, by virtue of the piston's position within cylinder unit 26, while allowing slippers 30 limited circumferential sliding movement relative to expander band 34. Additionally, a reduced dimension slot 102 is shaped to hold one slipper 30a in a fixed position relative to expander band 34 (see FIG. 4). What is essential for the present invention is the provision of some means that restricts the mobility of the expander band relative to one slipper to align the band with the other unrestricted slippers so the unrestricted slippers tend not to cause wear on the ends of the elongated slots.

Figure 6:
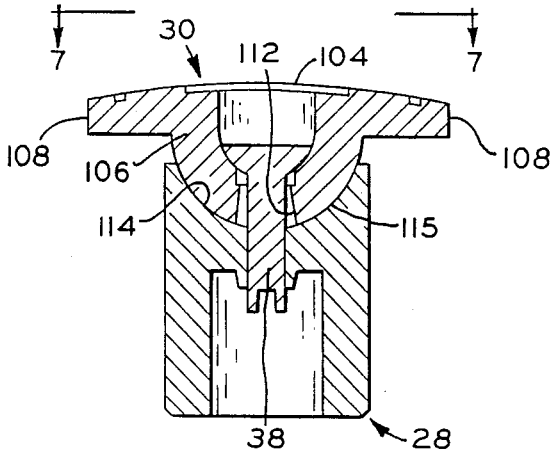
FIG. 6 is an enlarged sectional view of a piston and associated slipper taken from the plane perpendicular to the center of the axis of the hydraulic pump.
Figure 7:
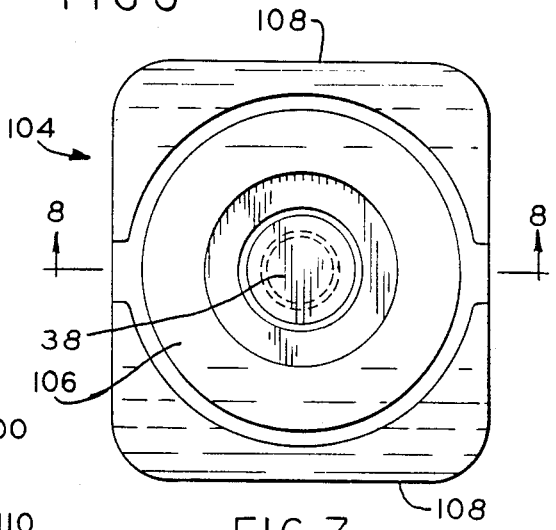
FIG. 7 is a view taken along line 7—7 of FIG. 6 in the direction of the arrows.
Figure 8:
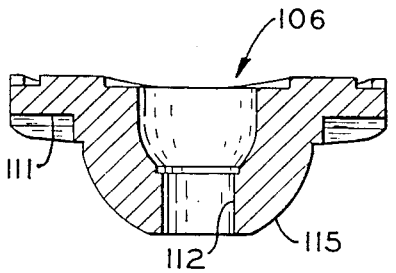
FIG. 8 is a view taken along line 8—8 of FIG. 7 in the direction of the arrows.

The structure of slippers 30 and 30a (which are similar to slippers 54) comprises outer portion 104 and base 106 as shown in FIGS. 6, 7, and 8. Outer portion 104 extends beyond expander band 34, having a rectangular aspect in its axially exterior view (FIG. 7) and an arc-shaped aspect in its radial sectional view (FIG. 6). Base 106 is cup-shaped, forming part of outer portion 104; and it extends through slots 100 or 102 within expander band 34 and receives connecting rivet 38 from piston 28. Base 106 slides within elongated slot 100, with peripheral edges 108 of base 106 being the portion of slippers 30 which are protected from abrading ends 110 of slots 100. Preferably, slippers 30, 30a, and 54 are formed from powdered metal and are phosphate coated. Portions 109 of band 34 engage shoulders 111 (FIGS. 1 and 8) of slippers 30 to urge them into engagement with track ring 32.

Slippers 30 are connected to piston 28 by rivet 38, with one end of rivet 38 being disposed in a tapered receiving hole 112 of base 106 and the other end secured to piston 28. Receiving hole 112 allows relative movement between rivet 38 and base 106, although with respect to piston 28 rivet 38 is immovable. Spherical recess 114 of piston 28 receives the semispherical portion 115 of base 106 to allow limited pivotal movement of slipper 30 relative to piston 28. This freedom of radial movement becomes important because piston 28 has virtually no freedom of movement within cylinder unit 26 except in the radial direction.

Figure 4:
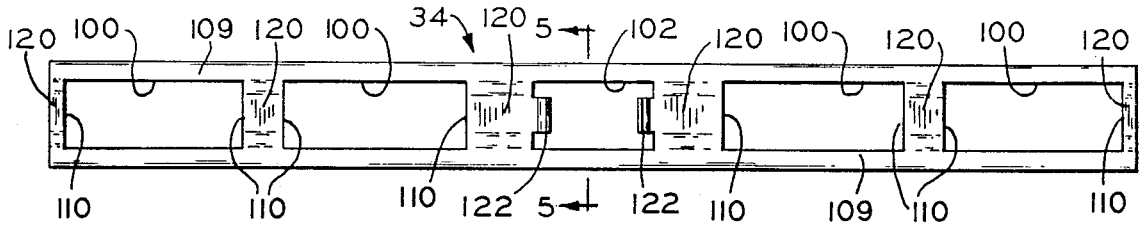
FIG. 4 is a plan view of the expander band of the present invention previous to being formed into an annular shape.
Figure 5:
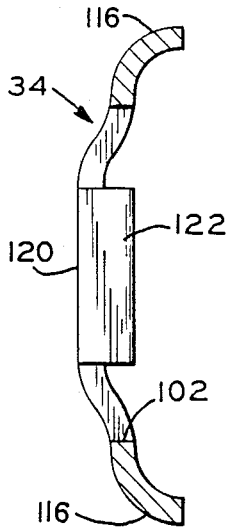
FIG. 5 is an enlarged sectional view of the expander band of FIG. 4 taken along line 5—5.
Figure 9:
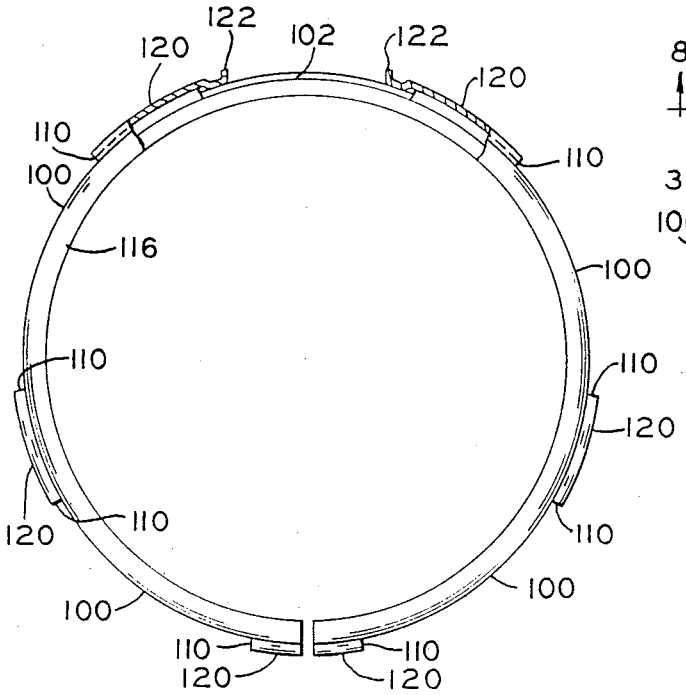
FIG. 9 is a top plan view of the expander band.

Expander band 34 of the preferred embodiment is formed from a flat, planar rectangularly shaped metal, preferably steel, band. Preferably, the reduced dimension slot 102 is centrally disposed with two elongated slots 100 on each side (FIG. 4). Edge flanges 116 are created by a lengthwise bend and center portions 120 are formed to protrude beyond the circumference of expander band 34 approximately at positions between slots 100 and slot 102, and the ends of expander band 34. The slots and flanges of expander band 34 are formed before bending expander band 34 into its cylindrical form as shown in FIG. 9. Preferably, expander band 34 is bent into a cylindrical form slightly larger than track ring 32 (as is expander band 58 relative to track ring 56) so that each band 32 and 58 has a spring-like tension for pressing slippers 30 or 54 into track ring 32 or 56, respectively.

Reduced dimension slot 102 is formed by bent flange portions 122 (see FIGS. 3, 4, and 9). Flanges 122 extend from edges of reduced dimension slot 102 to contact peripheral edges 108 of outer portion 104 of slipper 30a. Flanges 122 tend to fix the position of slipper 30a, with the consequence being that the position of expander band 34 is keyed or located by the position of cylinder unit 26.

By providing reduced dimension slot 102, the present invention prevents excessive relative movement between expander band 34 and slippers 30 to prevent the peripheral edges 108 of slippers 30 from striking ends 110 of elongated slots 100. When slipper 30a is fixed in position relative to expander band 34 in slot 102, the other slippers 30 can move relative to band 34 but only within a limited range within elongated slots 100. This ensures that peripheral edges 108 of slippers 30 will not contact side ends 110 of elongated slots 100 and the movement of slippers 30 is limited to the middle of elongated slots 100. Thus, undesirable wear and chipping are prevented by the design of expander band 34.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and falls within the limits of the appended claims.

What is claimed is:

1. A hydraulic pump or motor comprising:

a cylinder unit comprising a plurality of radial cylinders and a plurality of pistons, each said piston positioned within one of said cylinders, each said piston attached to an associated slipper;

a track ring positioned about said cylinder unit and engaging said slippers; and an expander band means disposed around said cylinder unit for urging said slippers against said track ring, said expander band including a fixed holding means for holding one of said slippers in a fixed position relative to said expander band, and said expander band further including a plurality of variable holding means disposed circumferentially around said expander band for allowing circumferential movement of said other slippers relative to said expander band so that as said cylinder unit rotates said other slippers have a limited range of movement relative to said expander band.

2. The hydraulic pump or motor of claim 1 wherein said slippers comprise an outer portion, a base portion, and peripheral edges disposed at circumferential ends of said slipper outer portion, and each said variable holding means comprises a rectangularly shaped elongated slot in said expander band, each said elongated slot having a height greater than the height of said slipper base portions, each said elongated slot having a width in the range of two to three times the circumferential width of said slipper base portions, said slipper outer portion having a height greater than said slipper base height, said slipper outer portion structured and arranged to extend beyond the outer circumference of said expander band and to allow said slipper peripheral edges to avoid abutting peripheries of said elongated slots.

3. The hydraulic pump or motor of claim 1 wherein each said variable holding means comprises a rectangularly shaped elongated slot in said expander band, each said elongated slot having a height less than the height of outer portions of said slippers, each said elongated slot having a width in the range of two to three times the circumferential width of said slipper outer portion.

4. The hydraulic pump or motor of claim 8 wherein said fixed holding means comprises a reduced dimension slot in said expander band having edges having a circumferential width substantially equal to the circumferential width of said slippers.

5. The hydraulic pump or motor of claim 1 wherein each said variable holding means comprises an elongated slot and said fixed holding means comprises a reduced dimension slot smaller than said elongated slots.

6. The hydraulic pump or motor of claim 5 wherein said expander band comprises a metal band having a spring-like tension for pressing said slippers against said track rings.

7. A hydrostatic transmission comprising:

a radial piston hydraulic pump coupled to an input shaft, said hydraulic pump including a first cylinder unit and a plurality of first pistons disposed in first cylinders of said first cylinder unit, each said first piston having an associated slipper;

a pintle for transmitting a fluid flow coupled to said pump;

a radial piston hydraulic motor coupled to said pintle and to an output shaft, said hydraulic motor including a second cylinder unit and a plurality of second pistons disposed in second cylinders of said second cylinder unit, each said second piston having an associated slipper;

a first track ring positioned about said hydraulic pump;

a second track ring positioned about said hydraulic motor; and first and second expander bands disposed respectively around said first and second cylinder units, each said expander band pressing respective said slippers radially outward against said first and second track rings, each said expander band including a fixed holding means for holding one of said slippers in a fixed position relative to said expander band, and a plurality of variable holding means disposed circumferentially on said expander band, said variable holding means retaining and allowing circumferential movement of others of said slippers relative to said expander band, said first and second expander bands structured and arranged to permit said other slippers to move within a predefined range relative to said expander band as said cylinder unit rotates.

8. The hydrostatic transmission of claim 7, wherein each said slipper comprises an outer portion, a base portion, and peripheral edges disposed at circumferential ends of said slipper outer portion, and each said variable holding means comprises a rectangularly shaped elongated slot in said expander band, each said elongated slot having a height greater than the height of said slipper base portion, each said elongated slot having a width in the range of two to three times the circumferential width of said slipper base portion, said slipper outer portion having a height greater than said slipper base height, said slipper outer portion structured and arranged so that said slipper outer portion extends beyond the outer circumference of said expander band and said slipper peripheral edges avoid abutting peripheries of said elongated slots.

9. The hydrostatic transmission of claim 7 wherein each said variable holding means comprises a rectangularly shaped elongated slot in said expander band, each said elongated slot having a height generally equal to the height of outer portions of said slippers, each said elongated slot having a width wider than the circumferential width of said slipper outer portion.

10. The hydrostatic transmission of claim 1 wherein said fixed holding means comprises a reduced dimension slot in said expander band having edges having a circumferential width substantially equal to the circumferential width of said slippers.

11. The hydrostatic transmission of claim 7 wherein each said variable holding means comprises an elongated slot and said fixed holding means comprises a reduced dimension slot smaller than said elongated slots.

12. The hydrostatic transmission of claim 11 wherein said expander band comprises a metal band having a spring-like tension for pressing said slippers against said track rings.

* * * * *